US006368152B1

(12) United States Patent
Takeguchi

(10) Patent No.: US 6,368,152 B1
(45) Date of Patent: Apr. 9, 2002

(54) ELECTRONIC EQUIPMENT TERMINAL CONNECTOR AND ELECTRONIC EQUIPMENT AND ELECTRONIC TERMINAL CONNECTOR UNIT

(75) Inventor: Mitsuhiro Takeguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/497,999

(22) Filed: Feb. 4, 2000

(30) Foreign Application Priority Data

Mar. 31, 1999 (JP) ..... 11-090513

(51) Int. Cl.[7] ..... H01R 13/73
(52) U.S. Cl. ..... 439/557; 439/562; 439/79
(58) Field of Search ..... 439/557, 562, 439/79

(56) References Cited

U.S. PATENT DOCUMENTS

| | | | | |
|---|---|---|---|---|
| 3,530,426 A | | 9/1970 | Snyder, Jr. | |
| 3,643,205 A | | 2/1972 | Elkins | |
| 5,145,385 A | | 9/1992 | Takano | |
| 5,525,074 A | * | 6/1996 | Tsuji et al. | 439/557 |
| 5,632,628 A | | 5/1997 | Wagner | |
| 5,709,557 A | * | 1/1998 | Martin et al. | 439/79 |
| 5,836,786 A | * | 11/1998 | Pepe | 439/557 |
| 5,934,913 A | * | 8/1999 | Kodama | 439/557 |
| 6,089,909 A | * | 7/2000 | Tokuwa | 439/557 |

FOREIGN PATENT DOCUMENTS

| | | | |
|---|---|---|---|
| DE | 0258382 | * 11/1967 | 439/557 |
| DE | 36 05 063 C1 | 10/1987 | |
| JP | 2-153596 | 6/1990 | |

* cited by examiner

*Primary Examiner*—Tho D. Ta
(74) *Attorney, Agent, or Firm*—Nixon & Vanderhye P.C.

(57) ABSTRACT

An electronic equipment terminal connector of the present invention is to be attached to an electronic equipment chassis by inserting a portion of an insulator composed of a plurality of terminal pins linked to one another into an opening section of the electronic equipment chassis so as to make an electrical connection between the terminal pins and a substrate portion in the electronic equipment chassis, and the electronic equipment terminal connector is provided with a stop section which stops the insulator on the electronic equipment chassis while the portion of the insulator is inserted into the opening section of the electronic equipment chassis.

22 Claims, 12 Drawing Sheets

30
31
32
32a
32b
32c
A

FIG. 11(b) *(Prior Art)*
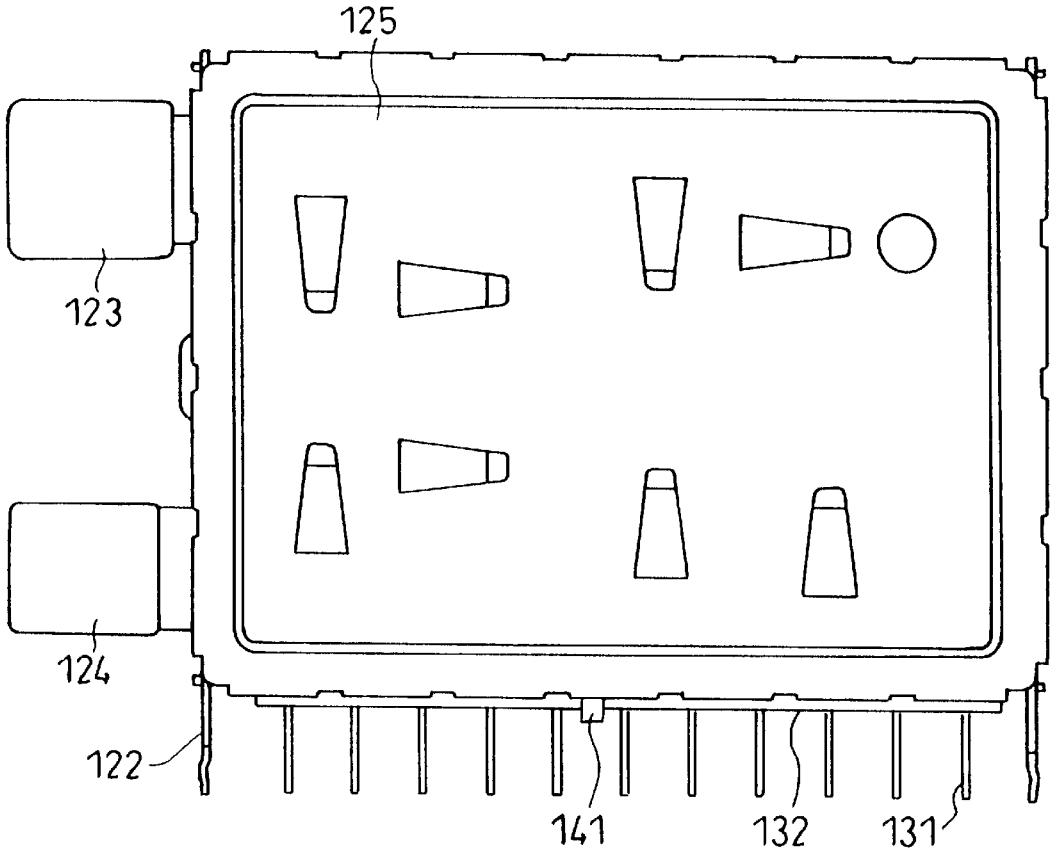
FIG. 11(a) *(Prior Art)*
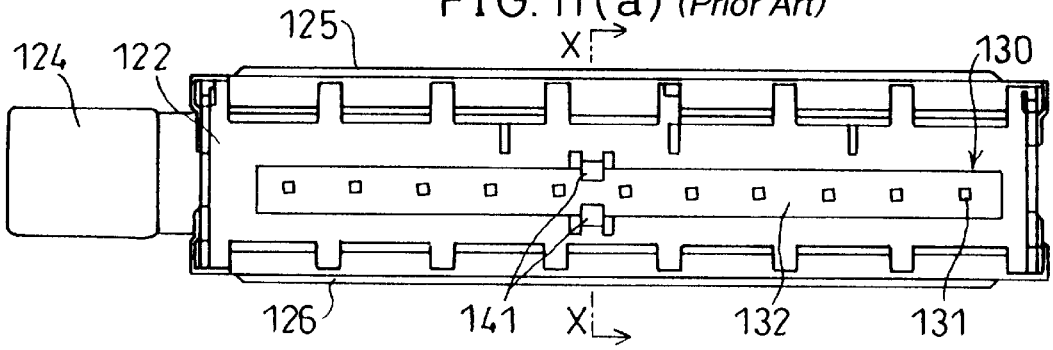

ELECTRONIC EQUIPMENT TERMINAL CONNECTOR AND ELECTRONIC EQUIPMENT AND ELECTRONIC TERMINAL CONNECTOR UNIT

FIELD OF THE INVENTION

The present invention relates to an electronic equipment terminal connector, electronic equipment, and electronic equipment terminal connector unit suitable for electric tuners used in television receivers, VCRs, satellite broadcasting receivers, and other electronic devices.

BACKGROUND OF THE INVENTION

Electric tuners used for television receivers, VCRs, satellite broadcasting receivers, and other electronic devices are one example of electronic equipment which is provided with an electronic equipment terminal connector in which a plurality of terminal pins are linked to one another by an insulator.

To bring the electric tuner in actual operation, it is required to externally supply a voltage for driving amplifier circuits, local oscillator circuits, and frequency converter circuits in the electric tuner, and also a synchronize voltage for synchronizing band-pass filters of input circuits and inter-stage circuits, and PLL control data when making the synchronization by PLL.

For such a purpose, the electric tuner employs a connection terminal for the external connection. As such a connection terminal, feed-through capacitors and terminal pins have been known conventionally.

FIG. 8(*a*) and FIG. 8(*b*) show an electric tuner employing feed-through capacitors as the connection terminal, in which FIG. 8(*a*) is a front view of the electric tuner and FIG. 8(*b*) is a plan view of the electric tuner of FIG. 8(*a*).

As shown in FIG. 8(*a*) and FIG. 8(*b*), the electric tuner has an arrangement in which a plurality of feed-through capacitors 121 are provided on one of the side surfaces of a chassis angle 122, and an antenna input terminal 123 and antenna output terminal 124 are provided on another side surface of the chassis angle 122, i.e., the surface perpendicular to the surface on which the feed-through capacitors 121 are provided, and an upper shield cover 125 and lower shield cover 126 are provided on upper and lower surfaces of the chassis angle 122.

In this electric tuner, the plurality of feed-through capacitors 121 are fixed on the chassis angle 122 by solder. In the chassis angle 122, the terminal sections (not shown) of the feed-through capacitors 121 are connected to a print substrate (not shown).

FIG. 9(*a*) and FIG. 9(*b*) show an electric tuner employing terminal pins as the connection terminal, in which FIG. 9(*a*) is a front view of the electric tuner and FIG. 9(*b*) is a plan view of the electric tuner of FIG. 9(*a*).

In this electric tuner, instead of the feed-through capacitors 121 as shown in FIG. 8(*a*) and FIG. 8(*b*), a plurality of terminal pins 128 are directly inserted and solder fixed on a print substrate 127 provided in the chassis angle 122.

The electric tuner employing feed-through capacitors as the connection terminal has drawbacks that it is more expensive than the electric tuner employing the terminal pins and it takes more time to make connections.

Meanwhile, in the electric tuner in which terminal pins as the connection terminal are directly fixed on the print substrate, because individual pins are merely soldered directly on the print substrate, the terminal pins tend to come off easily and the problem of weak terminal portion is presented.

In order to increase the strength of the terminal portion, there has been proposed an electronic equipment terminal connector 130 as shown in FIG. 10(*a*) through FIG. 10(*e*) for connecting an external power source, etc., and electronic equipment, in which FIG. 10(*a*) is a front view, FIG. 10(*b*) is a plan view, FIG. 10(*c*) is a bottom view, FIG. 19(*d*) is a left side view, and FIG. 10(*e*) is a right side view.

The terminal connector 130 has an arrangement in which a plurality of terminal pins 131 are linked to one another in a straight line by an insulator 132 of a rectangular shape. Such a terminal connector is disclosed as a capacitor array, for example, in Japanese Unexamined Patent publication No. 153596/1990 (Tokukaihei 2-153596) (Published Date: Jun. 13, 1990).

FIG. 11(*a*) and FIG. 11(*b*) show an electric tuner to which the terminal connector 130 having the above arrangement is attached, in which FIG. 11(*a*) is a front view and FIG. 11(*b*) is a plan view.

As shown in FIG. 11(*a*), the terminal connector 130 is arranged such that the insulator 132 is fixed on the chassis angle 122 by a fixing tongue 141. Here, as shown in FIG. 12, the terminal pins 131 are connected to the print substrate 127 in the chassis angle 122. FIG. 12 shows a main portion of the cross sectional view of FIG. 11(*a*) taken along the line X—X.

The following describes how the electric tuner employing the terminal connector 130 is assembled, referring to FIGS. 11(*a*) and (*b*) and FIG. 12.

1. The antenna input terminal 123 and antenna output terminal 124 are fixed on the chassis angle 122 by bezel or solder.

2. The terminal connector 130 is attached to the chassis angle 122.

3. The print substrate 127 mounting chip components and insertion parts is fixed in position in the chassis angle 122.

4. The print substrate 127 and chassis angle 122, the print substrate 127 and terminal pins 131 of terminal connector 130, and the print substrate 127 and antenna input terminal 123 and antenna output terminal 124 are each soldered with one another by reflow or flow.

5. After adjustment, the upper shield cover 125 and lower shield cover 126 are attached to the chassis angle 122.

However, in the electronic equipment employing the electronic equipment terminal connector 130 as shown in FIG. 10(*a*) through FIG. 10(*e*), i.e., in the electric tuner as shown in FIGS. 11(*a*) and (*b*) and FIG. 12, when the terminal connector 130 is to be attached to the chassis angle 122, the fixing tongue 141 as shown in FIGS. 11(*a*) and (*b*) and FIG. 12 is provided at the edge portion of the opening section 122*a* on a side surface of the chassis angle 122 through which the terminal connector 130 is to be inserted, and the insulator 132 of the terminal connector 130 is fixed on the chassis angle 122 by bending the fixing tongue 141.

Therefore, a step of bending the fixing tongue 141 is required in the process of attaching the terminal connector 130 to the chassis angle 122, thus making the process complex and operability suffers.

SUMMARY OF THE INVENTION

The present invention was made to solve the foregoing problems, and it is an object of the present invention to provide an electronic equipment terminal connector, electronic equipment, and electronic equipment terminal connector unit, by which an electronic equipment terminal connector in which a plurality of terminal pins are linked to one another by an insulator can be fixed easily on an electronic equipment chassis (chassis angle) only by inserting the electronic equipment terminal connector into an opening section of the electronic equipment chassis when making attachment.

In order to achieve the foregoing object, an electronic equipment terminal connector of the present invention is to be attached to an electronic equipment chassis by inserting a portion of an insulator composed of a plurality of terminal pins linked to one another into an opening section of the electronic equipment chassis so as to make an electrical connection between the terminal pins and a substrate portion in the electronic equipment chassis, and the electronic equipment terminal connector is provided with a stop section which stops the insulator on the electronic equipment chassis while the portion of the insulator is inserted into the opening section of the electronic equipment chassis.

With this arrangement, the electronic equipment terminal connector can be attached to the electronic equipment chassis only by inserting a portion of the insulator of the electronic equipment terminal connector into the opening section of the electronic equipment chassis. Thus, it is not required to provide a conventionally required step of bending a fixing tongue of the electronic equipment chassis by a bezel process, etc., thus improving operability. Further, a process of forming a fixing tongue on the electronic equipment chassis is not required either.

Further, in order to achieve the foregoing object, electronic equipment of the present invention in which an electronic equipment terminal connector including a plurality of terminal pins which are linked to one another by an insulator is attached to an electronic equipment chassis is arranged such that the electronic equipment terminal connector is attached to the electronic equipment chassis by inserting a portion of the insulator into an opening section of the electronic equipment chassis so as to make an electrical connection between the terminal pins and a substrate portion of the electronic equipment chassis, and the electronic equipment includes a stop section which stops the insulator on the electronic equipment chassis while the portion of the insulator is inserted into the opening section of the electronic equipment chassis.

With this arrangement, because the opening section is provided on the surface of the electronic equipment chassis where the terminal connector is to be positioned, and the stop section which is stopped at the opening section when the portion of the insulator of the terminal connector is inserted into the opening section is used as the terminal connector, the terminal connector can be easily fixed only by inserting a portion of the insulator into the opening section of the electronic equipment chassis. Thus, it is not required to provide a conventionally required step of bending a fixing tongue of the electronic equipment chassis by a bezel process, etc., thus improving operability. Further, a process of forming a fixing tongue on the electronic equipment chassis is not required either.

Further, in order to achieve the foregoing object, an electronic equipment terminal connector unit of the present invention has an arrangement in which the electronic equipment terminal connector is provided in plurality, which are linked to one another by a linking member.

With this arrangement, because a plurality of electronic equipment terminal connectors are linked to one another, they can be attached to the opening section of the electronic equipment chassis at once. Thus, the attachment of plural connectors and chassis can be made by attaching the electronic equipment terminal connector only by inserting it into the chassis and thereafter by cutting the linkage, thus greatly reducing manufacturing time.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) shows a state in which the stop section of the electronic equipment terminal connector is stopped on the side of a print substrate at the opening section of the chassis angle of the electronic equipment.

FIG. 2(*b*) is a plan view.

FIG. 8(*b*) is a plan view.

FIG. 9(*b*) is a plan view.

FIGS. 11(*a*) and (*b*) show an electric tuner to which the electronic equipment terminal connector of FIGS. 10(*a*) through (*e*) is attached as a terminal connector, in which FIG. 11(*a*) is a front view; and FIG. 11(*b*) is a plan view.

DESCRIPTION OF THE EMBODIMENTS

The following will describe one embodiment of the present invention referring to attached drawings. Note that, the following explanations are based on the case where a connection terminal is applied to an electric tuner as electronic equipment used for television receivers, VCRs, satellite broadcasting receivers, and other electronic devices. Also, the explanations are given based on an electronic tuner used for a television receiver for receiving television signals of the VHF band and UHF band.

The electric tuner selects a signal of a desired channel from television signals of the VHF band or UHF band which were received by a receiver antenna, and converts the selected signal to an intermediate frequency.

Figure 5:
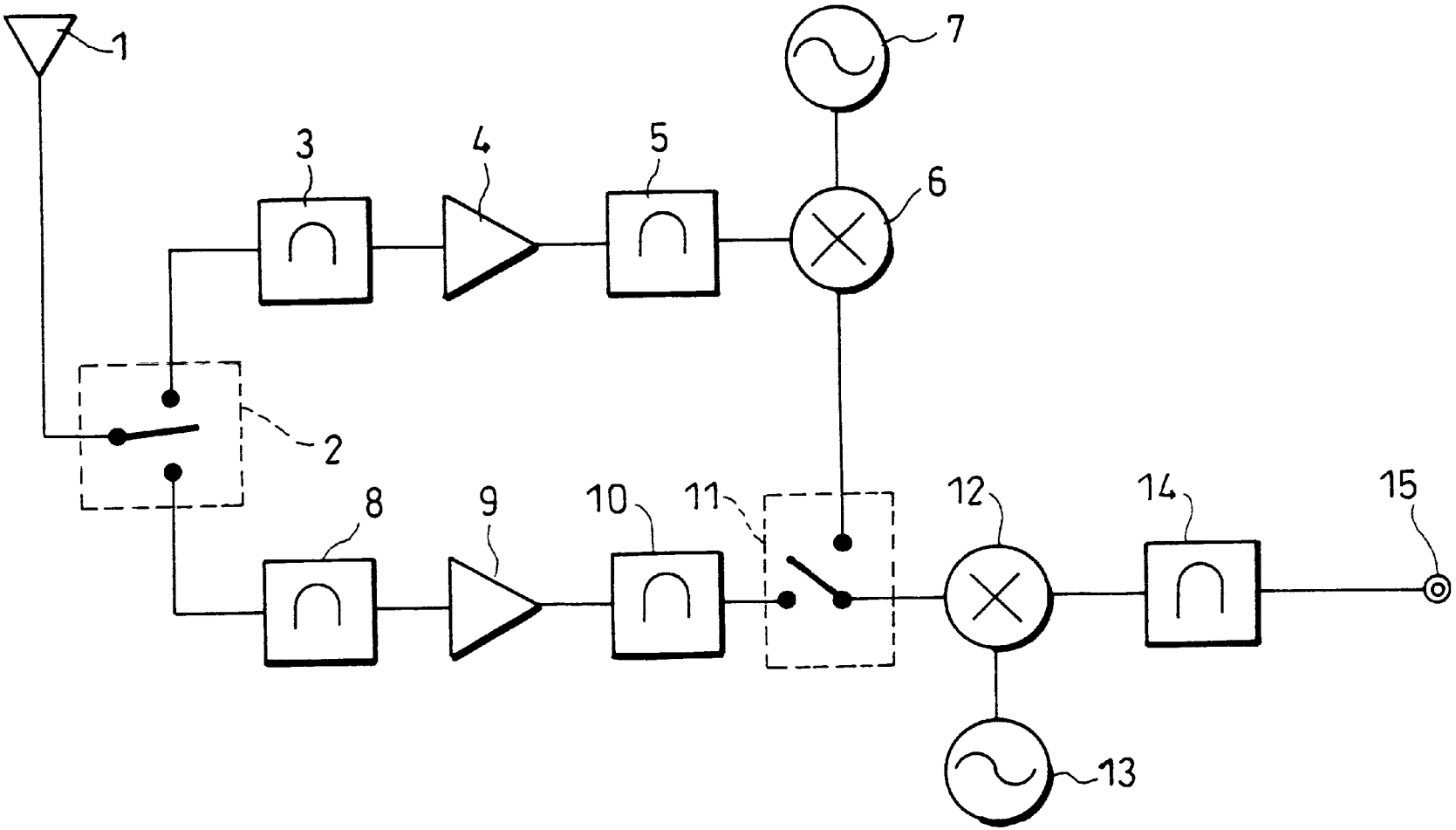
FIG. 5 is a schematic block diagram of the electric tuner of FIGS. 2(*a*) and (*b*).

FIG. 5 shows a basic circuit structure of the electric tuner. In the electric tuner, as shown in FIG. 5, a signal from antenna input (ANTIN) 1 is switched by a first switch 2 to be inputted to a first input circuit 3 when receiving a UHF channel and to a second input circuit 8 when receiving a VHF channel.

When receiving a UHF channel, a signal from the first input circuit 3 is amplified by a first radio frequency amplifier circuit 4, and via a first inter-stage circuit 5, it is converted to an intermediate frequency by a first frequency converter circuit 6. Then, via a second switch 11, the signal is amplified by a second frequency converter circuit 12, and via an intermediate frequency synchronize circuit 14, it is outputted from an intermediate frequency output terminal 15.

On the other hand, when receiving a VHF channel, a signal from the second input circuit 8 is amplified by a radio frequency amplifier circuit 9, and via a second inter-stage circuit 10 and through the second switch 11, it is converted to an intermediate frequency by the second frequency converter circuit 12, and via the intermediate frequency synchronize circuit 14, it is outputted from the intermediate frequency output terminal 15.

Here, the first and second input circuits 3 and 8 (1) cut interference waves near the intermediate frequency by a high-pass filter and (2) synchronize a desired channel frequency by a band-pass filter and prevent a local oscillator signal and intermediate frequency signal from leaking out of the electric tuner. The first and second radio frequency amplifier circuits 4 and 9 amplify received channel signals. The first and second inter-stage circuits 5 and 10 are band-pass filters which synchronize a desired channel frequency and attenuate signals other than the signals of desired channel frequency.

The local oscillator circuits 7 and 13 oscillate a frequency which is higher than that of the received channel signal by an intermediate frequency. The first and second frequency converter circuits 6 and 12 mix the received channel signal and the oscillation signals produced by the local oscillator circuits 7 and 13, respectively, to convert it into an intermediate frequency, which is the difference between the received channel signal and the oscillation signal. Note here that when receiving a UHF channel, the second frequency converter circuit 12 acts as an amplifier. The intermediate frequency synchronize circuit 14 is a band-pass filter and is synchronized with an intermediate frequency.

The first switch 2 is switched so that a signal flows to the first input circuit 3 when receiving a UHF signal and to the second input circuit 8 when receiving a VHF signal.

The second switch 11 is switch so that a signal flows to the first frequency converter circuit 6 when receiving a UHF signal and to the second inter-stage circuit 10 when receiving a VHF signal.

Figure 2B:
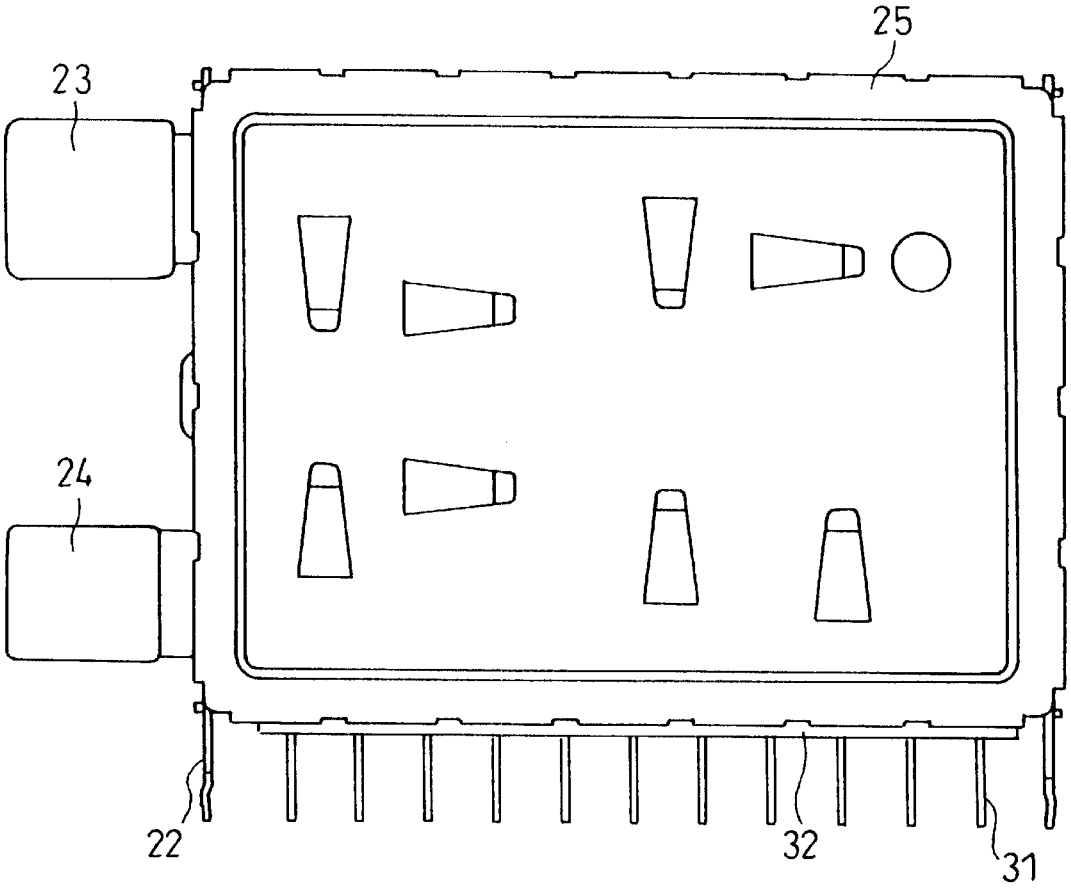
FIGS. 2(*a*) and (*b*) show an electric tuner to which the electronic equipment terminal connector of the present invention is attached, in which FIG. 2(*a*) is a front view.
Figure 2A:
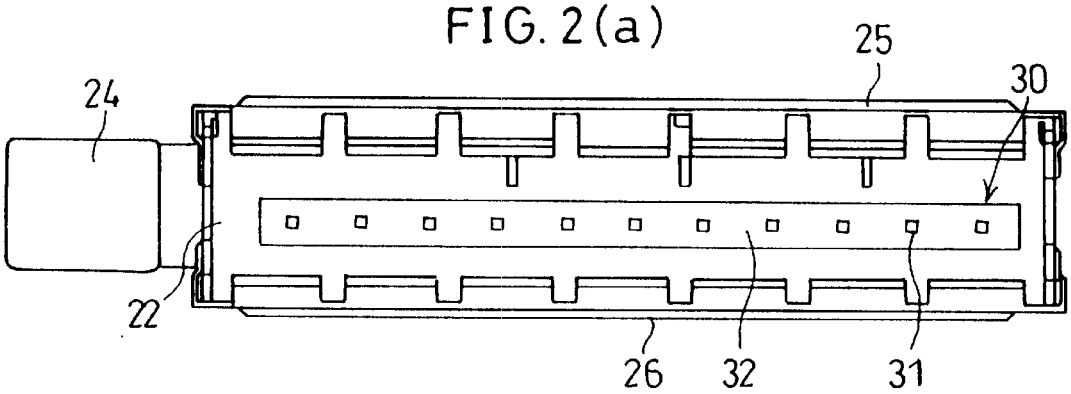

The circuits of the electric tuner as shown in FIG. 5 are enclosed in a casing as shown in FIG. 2(*a*) and FIG. 2(*b*), in which FIG. 2(*a*) is a front view of the electric tuner and FIG. 2(*b*) is a plan view of the electric tuner.

As shown in FIG. 2(*a*) and FIG. 2(*b*), the electric tuner has an arrangement including a chassis angle 22 as an electronic equipment chassis having a near rectangular shape which opens into upper and lower directions, an upper shield cover 25 covering the upper potion of the chassis angle 22, and a lower shield cover 26 covering the lower portion of the chassis angle 22, and the circuits as shown in FIG. 5 are stored in a space surrounded by the chassis angle 22, upper shield cover 25, and lower shield cover 26.

On one side of the chassis angle 22 are provided, as shown in FIG. 2(*b*), an antenna input terminal 23 and antenna output terminal 24. The antenna input terminal 23 receives a signal from the input antenna 1 as shown in FIG. 5.

Further, on another side of the chassis angle 22 is provided, as shown in FIG. 2(*a*), a terminal connector 30 as an electronic equipment terminal connector. The terminal connector 30 is electrically connected to a print substrate 27 (FIG. 1(*b*)) mounting the circuits stored in the chassis angle 22, and it serves as a terminal connector which is connected to supply sources of external voltages and data, etc., such as the voltage for driving the inner circuits of, for example, amplifier circuits, local oscillator circuits, and frequency converter circuits, and the synchronize voltage for synchronizing the band-pass filters of the input circuits and inter-stage circuits, and PLL control data when making the synchronization by PLL.

Figures 3A, 3B, 3C, 3D, 3E:
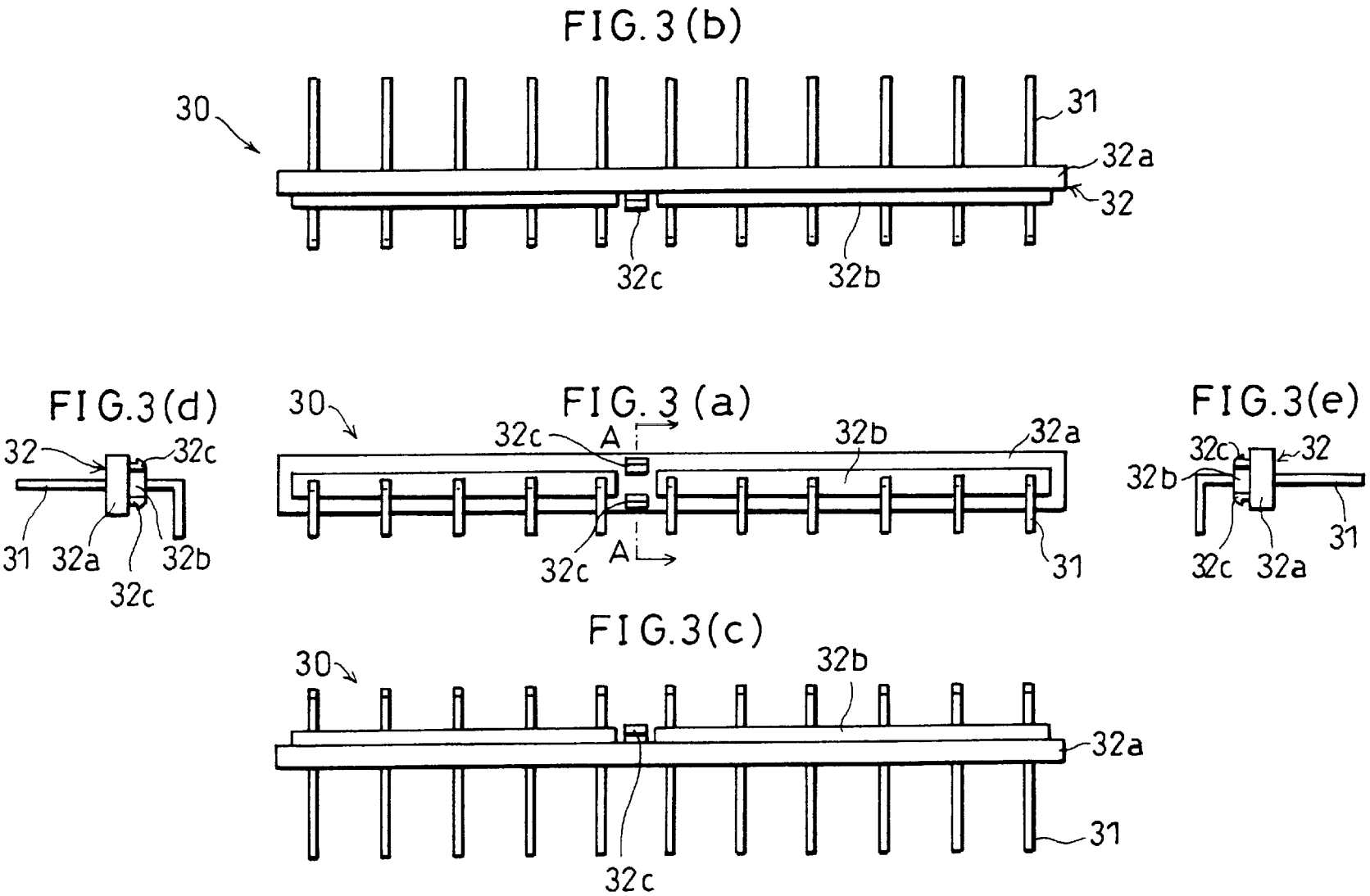
FIGS. 3(*a*) through (*e*) are explanatory drawings showing a schematic arrangement of the electronic equipment terminal connector of the present invention.
Figure 4:
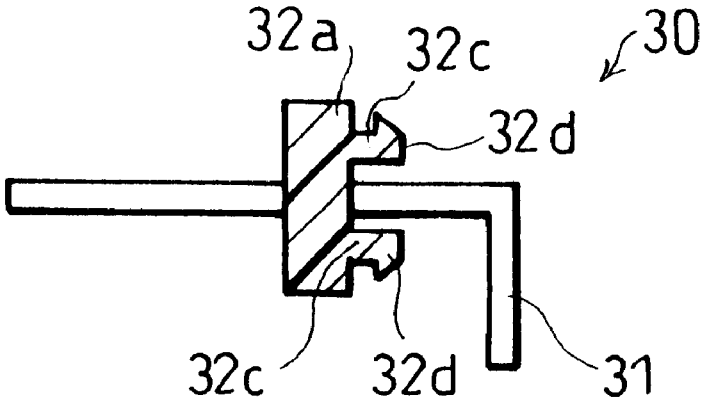
FIG. 4 is a cross sectional view of FIG. 3(*a*) taken along the line A—A.

As shown in FIG. 3(*a*) through FIG. 3(*e*), the terminal connector 30 has an arrangement in which a plurality of terminal pins 31 are linked to one another in a near straight line by an insulator 32.

The insulator 32 is made of a resin material having an insulating property, and has an integral structure including a platform section 32*a* of a near rectangular shape, two insertion sections 32*b* being provided on the platform section 32*a* as a portion of the insulator 32 and having a near rectangular shape and smaller than the platform section 32*a*, and a stop section 32*c* which is formed between the insertion sections 32*b* on the platform section 32*a*.

Figure 1:
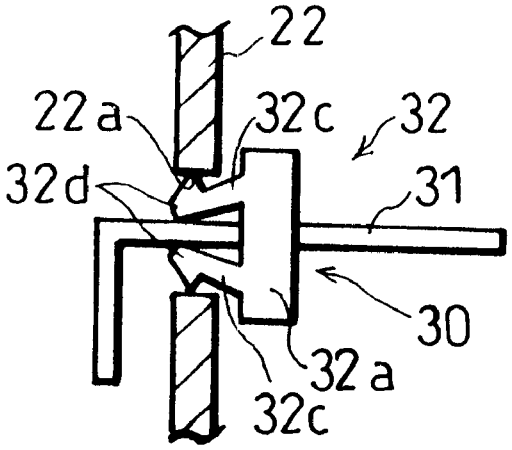
FIGS. 1(*a*) and 1(*b*) are explanatory drawings showing how an electronic equipment terminal connector of the present invention is attached to electronic equipment, in which FIG. 1(*a*) shows a state in which a stop section of the electronic equipment terminal connector is inserted into an opening section of a chassis angle of the electronic equipment.
Figure 1:
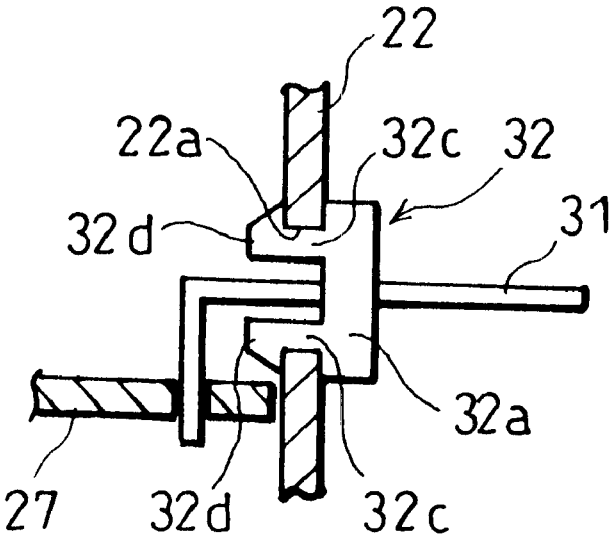

The platform section 32*a* is larger than an opening section 22*a* (FIG. 1(*b*)) of the chassis angle 22, and the insertion sections 32*b* are provided with the size which is insertable into the opening section. Thus, when the insulator 32 is attached to the chassis angle 22, only the platform section 32*a* is exposed.

The terminal pins 31 are formed at predetermined intervals, penetrating through the platform section 32*a* and insertion sections 32*b*, and as shown in FIG. 3(*d*) and FIG. 3(*e*), the end of the terminal pins 31 on the side of the insertion sections 32*b* is bent. Thus, when the terminal connector 30 is attached to the chassis angle 22, the terminal pins 31 are brought into contact with the connecting section of the print substrate 27 (FIG. 1(*b*)) in the chassis angle 22.

As shown in FIG. 3(*a*) through FIG. 3(*e*), the stop section 32*c* is formed outside of the side edge in the width direction of the insertion sections 32*b*, and is thicker than the insertion sections 32*b*. The stop section 32*c* is provided on the both sides in upper and lower directions of the terminal pins 31, and as shown in FIG. 1(*a*) and FIG. 1(*b*), the stop section 32*c* is stopped at the opening section 22*a* of the chassis angle 22. Namely, the stop section 32*c* is provided with a projecting section 32*d* such that the stop section 32*c* is stopped on the edge of the opening section 22*a* on the side of the print substrate 27 while the insertion sections 32*b* constituting the insulator 32 are partially inserted into the opening section 22*a* of the chassis angle 22.

FIG. 1(*b*) is a side cross section of a main portion in the vicinity of where the terminal connector 30 is stopped by the stop section 32*c*. That is, as shown in FIG. 1(*a*), when inserting the terminal connector 30 into the opening section 22*a* of the chassis angle 22, the stop section 32*c* being separated by a predetermined gap on the both sides of the terminal pins 31 is pushed inward to approach the terminal pins 31. Then, as shown in FIG. 1(*b*), when inserted completely, the stop section 32*c* returns to its original shape by the elasticity of the insulator 32, thus fixing the terminal connector 30 as the projecting section 32*d* of the stop section 32*c* is locked with the inner surface on the edge of the opening section 22*a* of the chassis angle 22. Namely, as shown in FIG. 1(*b*), the terminal connector 30 is fixed as the projecting section 32*d* of the stop section 32*c* of the terminal connector 30 is locked with the inner surface on the edge of the opening section 22*a* of the chassis angle 22.

Note that, in the present embodiment, the stop section 32*c* is separated on the both sides so as to be stopped on the upper and lower sides of the opening section 22*a* of the chassis angle 22, thus fixing the terminal connector 30 further stably on the chassis angle 22.

As described, with the terminal connector 30 having the described arrangement, the terminal connector 30 can easily be fixed on the chassis angle 22 only by inserting it into the opening section 22*a* of the chassis angle 22 constituting the electric tuner. Thus, it is not required to carry out the conventionally required step of bending the fixing tongue of the chassis by a bezel process, etc., thus improving operability. Further, a process of forming the fixing tongue on the chassis is not required either.

Figure 6:
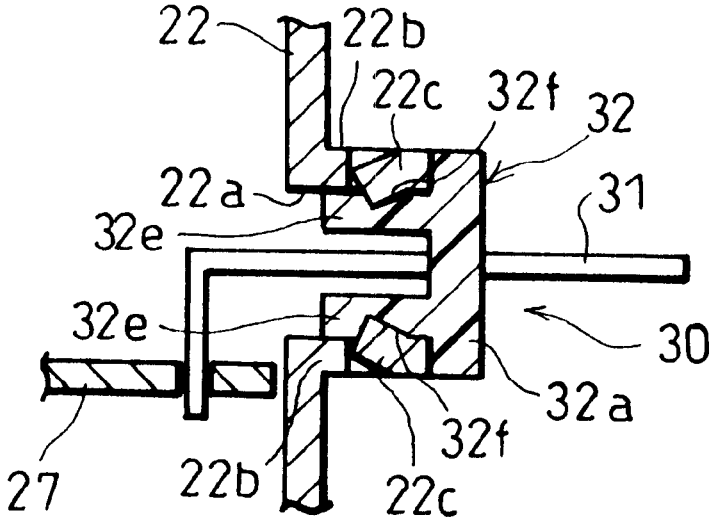
FIG. 6 is an explanatory drawing showing a state in which another electronic equipment terminal connector of the present invention is fixed on the chassis angle of the electronic equipment.

Instead of the stop section 32*c* of the terminal connector 30, it is possible alternatively to provide a stop section 32*e* having a notch 32*f* at predetermined positions as shown in FIG. 6. In this case, a fixing section 22*b* having on its inner surface a projecting section 22*c* for stopping the notch 32*f* of the stop section 32*e* is provided outwardly at the opening section 22*a* of the chassis angle 22.

Namely, as shown in FIG. 6, when the stop section 32*e* of the insulator 32 of the terminal connector 30 is inserted into the fixing section 22*b* of the chassis angle 22, the projecting section 22*c* on the inner surface of the fixing section 22*b* is stopped by the notch 32*f* of the stop section 32*e*, thus fixing the terminal connector 30.

In the state as shown in FIG. 6, when inserting the terminal connector 30 into the opening section 22*a* of the chassis angle 22, the attachment of the terminal connector 30 is made by utilizing the elasticity of the insulator 32 of the terminal connector 30 and of the projecting section 22*c* of the chassis angle 22, and when inserted, the projecting section 22*c* of the chassis angle 22 is engaged with the notch 32*f* of the stop section 32*e* of the terminal connector 30, thus fixing the terminal connector 30.

With this arrangement, as with the case of attaching the terminal connector 30 of FIG. 1(*a*) and FIG. 1(*b*) to the chassis angle 22, the terminal connector 30 can easily be fixed on the chassis angle 22 only by inserting the stop section 32*e* of the terminal connector 30 into the opening section 22*a* of the chassis angle 22. Thus, it is not required to carry out the conventionally required step of bending the fixing tongue of the chassis by a bezel process, etc., thus improving operability.

Figure 7:
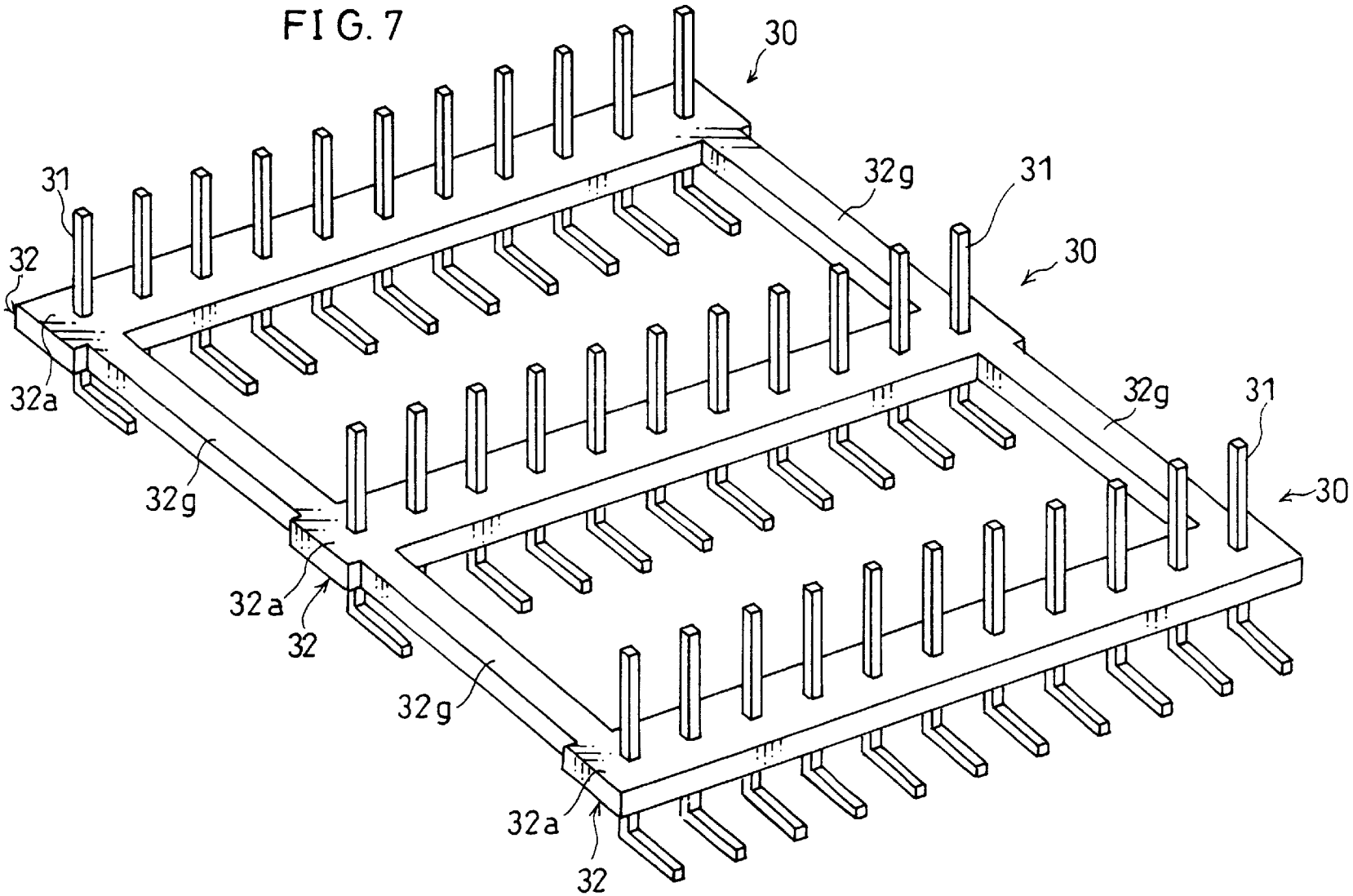
FIG. 7 is a schematic perspective view of an electronic equipment terminal connector unit of the present invention.
Figure 8:
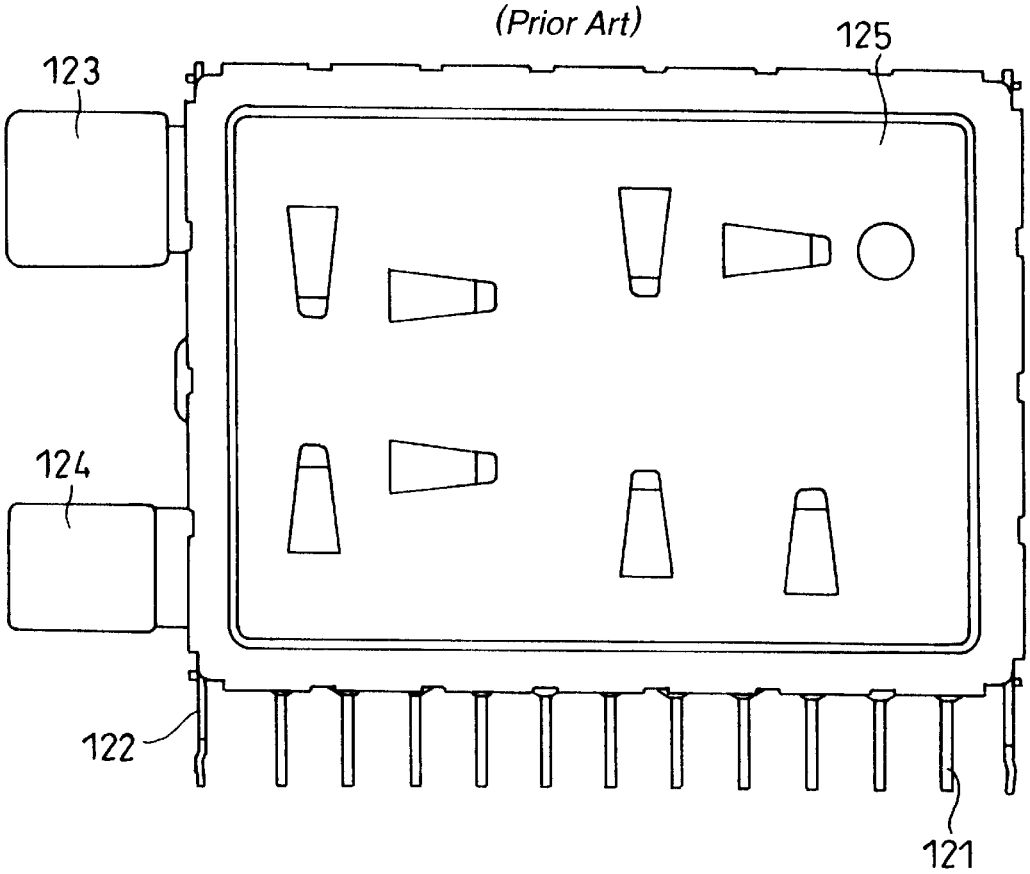
FIG. 8 (b) (Prior Art)
FIGS. 8(*a*) and (*b*) show an electric tuner which employs feed-through capacitors as a connection terminal, in which FIG. 8(*a*) is a front view.
Figure 8A:
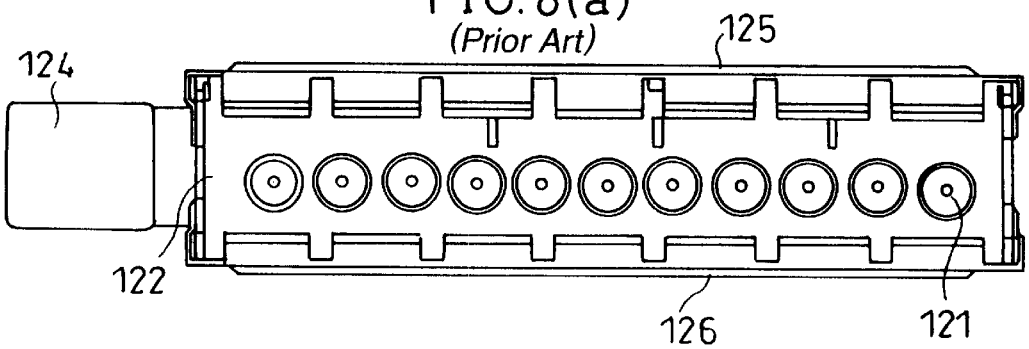
FIG. 8(a) (Prior Art)
Figure 9B:
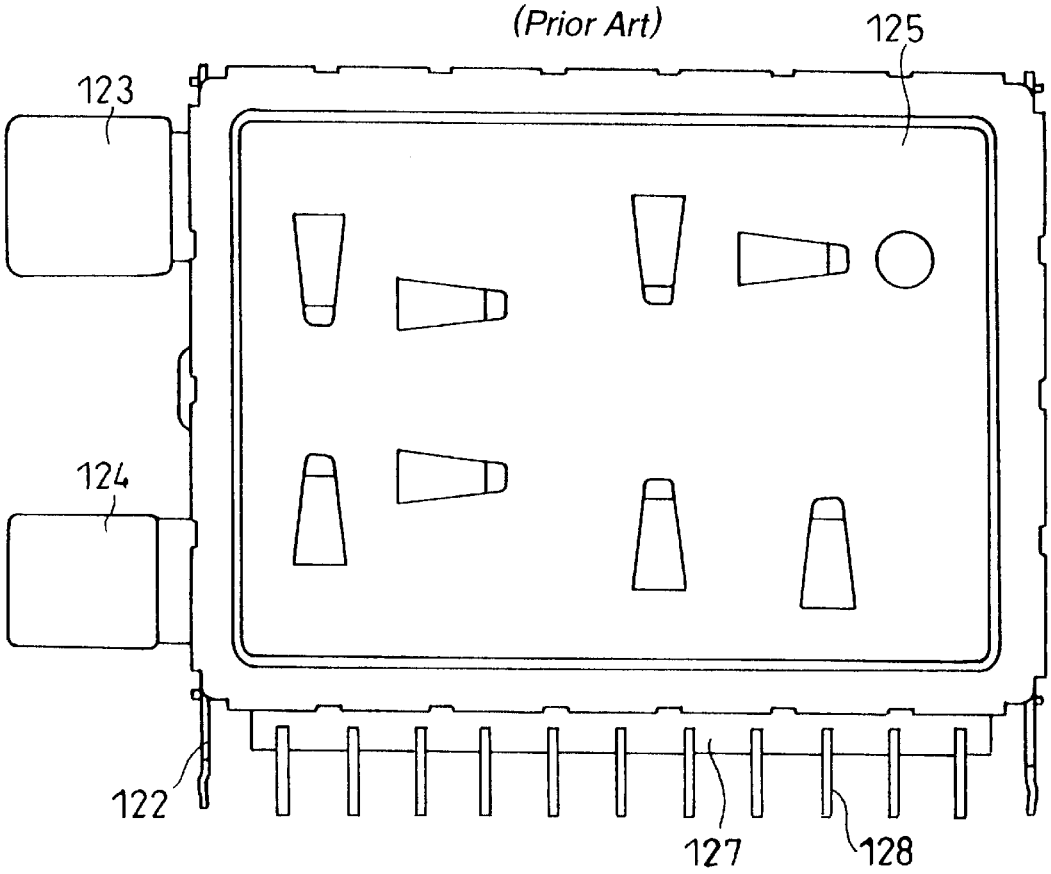
FIG. 9(b) (Prior Art)
FIGS. 9(*a*) and (*b*) show an electric tuner in which terminal pins as a terminal connector are directly connected to a print substrate, in which FIG. 9(*a*) is a front view.
Figure 9A:
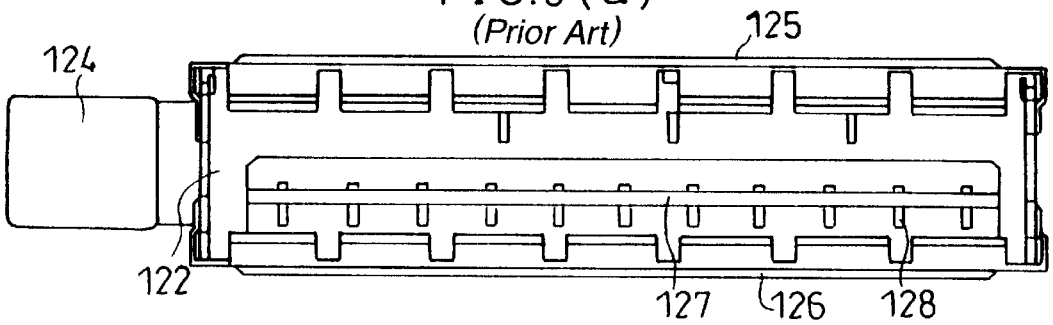
FIG.9(a) (Prior Art)
Figure 10E:
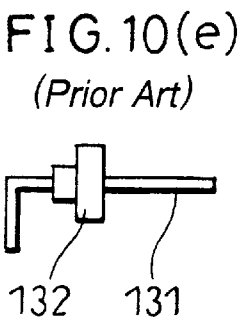
FIG. 10(e) (Prior Art)
FIGS. 10(*a*) through (*e*) are explanatory drawings showing a schematic arrangement of a conventional electronic equipment terminal connector.
Figure 10B:
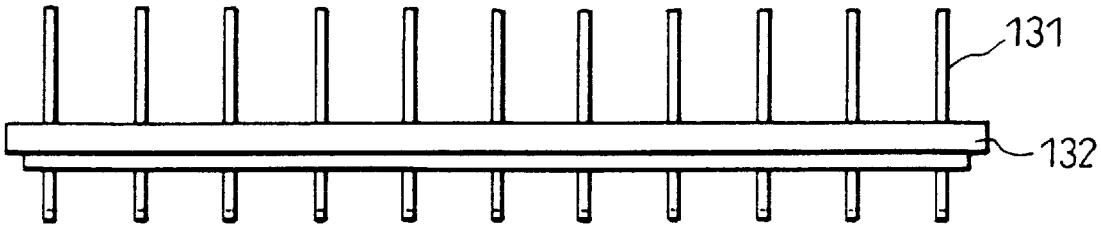
FIG. 10(b) (Prior Art)
Figure 10A:
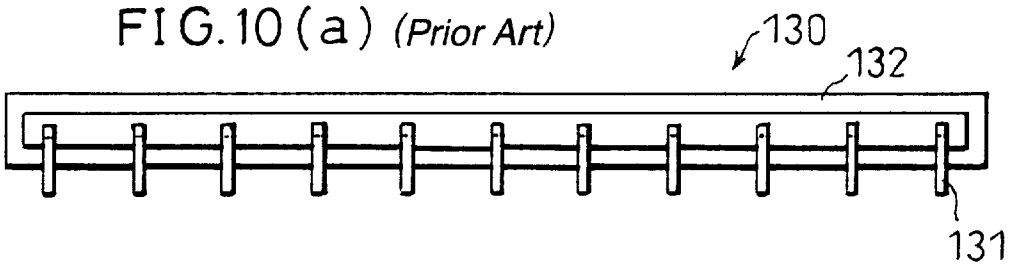
FIG. 10(a) (Prior Art)
Figure 10C:
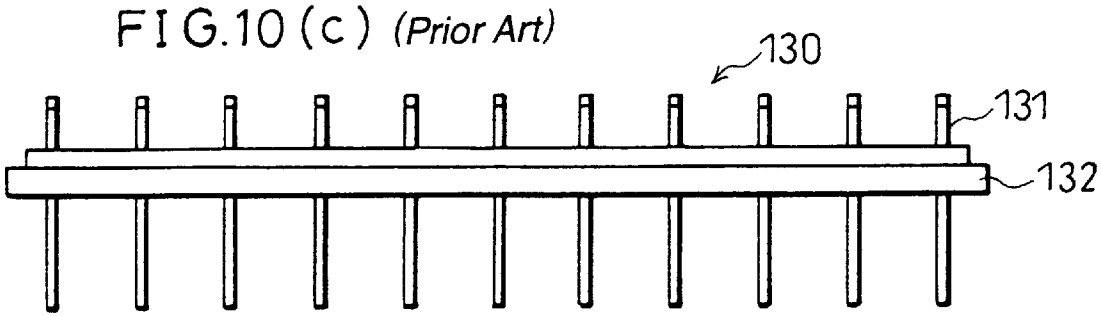
FIG. 10(c) (Prior Art)
Figure 10D:
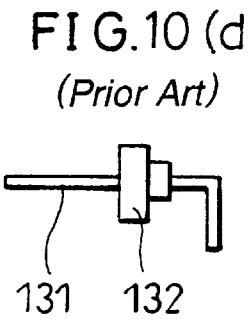
FIG. 10(d) (Prior Art)
Figure 12:
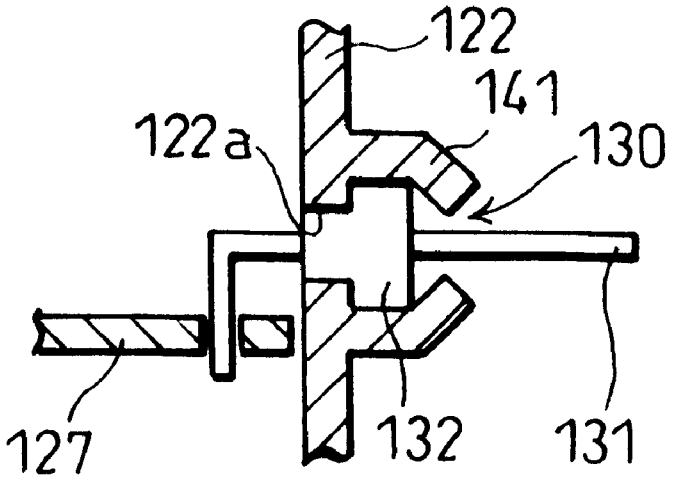
FIG. 12 (Prior Art)
FIG. 12 is a cross sectional view of FIG. 11(*a*) taken along the line X—X.

When the terminal connector 30 having the described arrangement is to be connected to the chassis angle 22 of the electric tuner, it takes effort to attach the terminal connector 30 to the chassis angle 22 one by one. Thus, in order to be efficient, as shown in FIG. 7, an electronic equipment terminal connector unit in which a plurality of terminal connectors 30 are linked to one another may be used. Namely, by using a plurality of terminal connectors 30 in which platform sections 32*a* of insulators 32 are connected to one another by arm section 32*g* as a linking member, and by positioning a plurality of chassis angles 22 at the same interval with the linked terminal connectors 30, it is possible to make attachment at once. Then, after attached, the arm section 32*g* is cut, thus obtaining the electric tuner with the terminal connector 30 attached conveniently and in a short period of time.

The above electronic equipment terminal connector unit is arranged such that a plurality of insulators 32 are linked to one another by the arm section 32*g*. However, the electronic equipment terminal connector unit can be manufactured more easily when it is integrally formed using a resin material having an insulating property. In such a case, the stop section 32*c* or 32*e* is formed simultaneously in the manufacturing process.

Thus, with the electronic equipment terminal connector unit having this arrangement, manufacturing time of the electric tuner can be greatly reduced. Note that, in FIG. 7, when connecting the platform sections 32*a* of the insulators 32 to one another, the linkage is made at two locations by the arm section 32*g*. However, not limiting to this, the linkage may be made at a single location or three or more locations.

Note that, the above embodiment described the case where only a single stop section 32*c* or 32*e* is provided stretching over the upper and lower sides. However, it may be provided in plurality, or alternatively a single of plural stop sections 32*c* or 32*e* may be provided only on one side. Further, the size of the stop sections 32*c* and 32*e* are not particularly limited and it can be changed appropriately.

Further, the positions of the stop sections 32*c* and 32*e* are not particularly limited as long as they allow the terminal connector 30 to be fixed on the chassis angle 22, and they can be provided at arbitrary positions.

Also, the above embodiment described the case where the terminal connector is applied to the electric tuner of the television receiver. However, the present invention is not limited to this, and as long as the terminal connector has the arrangement in which a plurality of connector pins are linked by an insulator, the present invention is applicable to any electronic equipment.

A first electronic equipment terminal connector of the present invention is composed of a plurality of terminal pins which are linked to one another by an insulator and is to be positioned on the surface of the electronic equipment chassis on which an opening section is provided, and the first electronic equipment terminal connector has an arrangement in which a projectile stop section is provided so as to be stopped on the inner surface on the edge of the opening section when inserted into the opening section of the electronic equipment chassis.

With the arrangement of the first electronic equipment terminal connector, because the projectile stop section is provided so as to be stopped and fixed on the inner surface on the edge of the opening section when inserted into the opening section of the electronic equipment chassis, the connector can be fixed easily only by inserting it into the opening section of the electronic equipment chassis. Thus, it is not required to provide a conventionally required step of bending a fixing tongue of the electronic equipment chassis by a bezel process, etc., thus improving operability. Further, a process of forming a fixing tongue on the electronic equipment chassis is not required either.

A second electronic equipment terminal connector of the present invention, having the arrangement of the first electronic equipment terminal connector, has an arrangement in which the stop section is provided on the both sides of the opening section so as to be stopped on the upper and lower sides of the opening section of the electronic equipment chassis.

With the arrangement of the second electronic equipment terminal connector, because the stop section is provided on the both sides of the opening section so as to be stopped on the upper and lower sides of the opening section of the electronic equipment chassis, the electronic equipment terminal connector can be fixed on the chassis further stably.

A third electronic equipment terminal connector of the present invention, having the arrangement of the first or second electronic equipment terminal connector, has an arrangement in which the stop section is provided on the insulator.

With the arrangement of the third electronic equipment terminal connector, because the stop section is formed on the insulator, the stop section can be easily provided. Namely, when forming the electronic equipment terminal connector by linking a plurality of terminal pins by resin molding, by using a molding cast for the stop section, the first or second electronic equipment terminal connector can be realized with ease.

First electronic equipment of the present invention includes the electronic equipment terminal connector which is composed of a plurality of terminal pins which are linked to one another by an insulator and which is to be positioned on at least one surface of the electronic equipment chassis, and the first electronic equipment has an arrangement in which an opening section is provided on the surface of the chassis on which the connector is to be positioned, and a projectile stop section is provided on the terminal connector so as to be stopped and fixed on the inner surface on the edge of the opening section when inserted into the opening section.

With the arrangement of the first electronic equipment, because the opening section is provided on the surface of the chassis on which the connector is to be positioned and the projectile stop section is provided on the terminal connector so as to be stopped and fixed on the inner surface on the edge of the opening section when inserted into the opening section, the terminal connector can be fixed easily only by inserting it into the opening section of the chassis.

Thus, it is not required to provide a conventionally required step of bending a fixing tongue of the electronic equipment chassis by a bezel process, etc., thus improving operability. Further, a process of forming the fixing tongue on the electronic equipment chassis is not required either.

Second electronic equipment of the present invention includes the electronic equipment terminal connector which is composed of a plurality of terminal pins which are linked to one another by an insulator and which is to be positioned on at least one surface of the electronic equipment chassis, and the second electronic equipment has an arrangement in which an opening section is provided on the surface of the chassis on which the terminal connector is to be provided, and a fixing section having on its inner surface a projection is provided outwardly on the both sides at least partially on the edge of the opening section, and a notched stop section is provided on the terminal connector so as to be stopped and fixed by the projection when inserted into the opening section.

With the arrangement of the second electronic equipment, because the opening section is provided on the surface of the chassis on which the terminal connector is to be provided, and a fixing section having on its inner surface a projection is provided outwardly on the both sides at least partially on the edge of the opening section, and a notched stop section is provided on the terminal connector so as to be stopped and fixed by the projection when inserted into the opening section, the terminal connector can be fixed easily only by inserting it into the opening section of the electronic equipment chassis. Thus, it is not required to provide a conventionally required step of bending a fixing tongue of the electronic equipment chassis, thus improving operability.

Further, an electronic equipment terminal connector, having the arrangement of one of the first through third electronic equipment terminal connector, or to be used for the first or second electronic equipment, has an arrangement in which a plurality of electronic equipment terminal connectors are linked to one another, and they can be attached at once to the opening section of a plurality of electronic equipment chassis.

With the arrangement of this electronic equipment terminal connector, because a plurality of electronic equipment terminal connectors are linked to one another, and they can be attached at once to the opening section of a plurality of electronic equipment chassis, the attachment of plural connectors and chassis can be made by attaching the electronic equipment terminal connector only by inserting it into the electronic equipment chassis and thereafter by cutting the linkage, thus greatly reducing manufacturing time.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An electronic equipment terminal connector to be attached to an electronic equipment chassis by inserting a portion of an insulator attached to a plurality of terminal pins linked to one another into an opening section of the electronic equipment chassis so as to make an electrical connection between the terminal pins and a substrate portion in the electronic equipment chassis, wherein said insulator of said electronic equipment terminal connector comprises:

a stop section which stops the insulator on both sides of the electronic equipment chassis when the portion of the insulator is inserted into the opening section of the electronic equipment chassis;

said stop section including a flexible projection section which flexes inwardly during insertion of the portion of the insulator into the opening section of the electronic equipment chassis, and flexes back outwardly after said insertion in order to stop the insulator on an interior side of said chassis; and wherein the portion of the insulator is inserted into the opening section from an exterior side of said chassis, and no portion of the terminal connector is inserted into the opening section from the interior side of said chassis.

2. The electronic equipment terminal connector as set forth in claim 1, wherein said stop section includes a notch which is engaged with a projection section of the opening section of the chassis when the portion of the insulator is in the opening section of the electronic equipment chassis.

3. The electronic equipment terminal connector as set forth in claim 1, wherein said stop section is provided on the insulator.

4. The electronic equipment terminal connector as set forth in claim 1, wherein said stop section is integrally provided with the insulator.

5. An electronic equipment terminal connector unit including the electronic equipment terminal connector of claim 1 in plurality, the electronic equipment terminal connectors being linked to one another by a linking member.

6. The terminal connector of claim 1, wherein said insulator does not contact said substrate portion.

7. The electronic equipment terminal connector of claim 1, wherein said stop section includes a projecting section that stops the insulator at an interior side of the chassis proximate the substrate portion when the portion of the insulator is in the opening section of the electronic equipment chassis.

8. The electronic equipment terminal connector as set forth in claim 1, wherein the insulator includes a platform section which is to contact an outer surface on a periphery of the opening section of the electronic equipment chassis and an insertion section which is provided on the platform section and which is insertable into the opening section, and said stop section is provided so as to be stopped at the opening section when the insertion section is inserted into the opening section.

9. The electronic equipment terminal connector as set forth in claim 8, wherein said stop section is provided at an arbitrary position on the platform section.

10. The electronic equipment terminal connector as set forth in claim 8, wherein said stop section includes a projecting section so that the insulator is stopped at an edge of the opening section on a side of the substrate portion while the insertion section is inserted into the opening section of the electronic equipment chassis.

11. The electronic equipment terminal connector as set forth in claim 8, wherein said stop section includes a notch which is engaged with a projecting section of the opening section while the insertion section is inserted into the opening section of the electronic equipment chassis.

12. Electronic equipment in which an electronic equipment terminal connector including a plurality of terminal pins which are linked to one another by an insulator is attached to an electronic equipment chassis, wherein the electronic equipment terminal connector is attached to the electronic equipment chassis by inserting a portion of the insulator into an opening section of the electronic equipment chassis so as to make an electrical connection between the terminal pins and a substrate portion of the electronic equipment chassis, and wherein said electronic equipment terminal connector comprises:

a stop section which stops the insulator on both sides of the electronic equipment chassis when the portion of the insulator is in the opening section of the electronic equipment chassis;

said stop section including a flexible projection section which flexes inwardly during insertion of the portion of the insulator into the opening section of the electronic equipment chassis, and flexes back outwardly after said insertion in order to stop the insulator on an interior side of said chassis; and wherein the portion of the insulator is inserted into the opening section from an exterior side of said chassis, and no portion of the terminal connector is inserted into the opening section from the interior side of said chassis.

13. The electronic equipment as set forth in claim 12, wherein said stop section includes a notch which is engaged with a projecting section of the opening section of the chassis when the portion of the insulator is in the opening section of the electronic equipment chassis.

14. The electronic equipment as set forth in claim 12, wherein said stop section is provided on the insulator.

15. The electronic equipment as set forth in claim 12, wherein said stop section is integrally provided with the insulator.

16. An electronic equipment terminal connector unit including the electronic equipment terminal connector provided in the electronic equipment of claim 12 in plurality, the electronic equipment terminal connectors being linked to one another by a linking member.

17. The electronic equipment of claim 12, wherein said stop section is part of said insulator, and wherein said insulator does not contact said substrate portion.

18. The electronic equipment of claim 12, wherein said stop section includes a projecting section that stops the insulator at the substrate portion side of the chassis when the portion of the insulator is in the opening section of the electronic equipment chassis.

19. The electronic equipment as set forth in claim 12, wherein the insulator includes a platform section which is to contact the opening section of the electronic equipment chassis and an insertion section which is provided on the platform section and which is engageable with the opening section, and said stop section is provided so as to be stopped at the opening section when the insertion section is engaged with the opening section.

20. The electronic equipment as set forth in claim 19, wherein said stop section is provided at an arbitrary position on the platform section.

21. The electronic equipment as set forth in claim 19, wherein said stop section includes a projecting section so that the insulator is stopped at an edge of the opening section on a side of the substrate portion while the insertion section is inserted into the opening section of the electronic equipment chassis.

22. The electronic equipment as set forth in claim 19, wherein said stop section includes a notch which is engaged with a projecting section of the opening section while the insertion section is inserted into the opening section of the electronic equipment chassis.

* * * * *

UNITED STATES PATENT AND TRADEMARK OFFICE

CERTIFICATE OF CORRECTION

PATENT NO. : 6,368,152 B1
DATED : April 9, 2002
INVENTOR(S) : Takeguchi

It is certified that error appears in the above-identified patent and that said Letters Patent is hereby corrected as shown below:

Title page,
Item [54], please note that the Title is missing the third occurrence of the word "equipment". Please correct the Title as shown below:

-- ELECTRONIC EQUIPMENT TERMINAL CONNECTOR AND ELECTRONIC EQUIPMENT AND ELECTRONIC EQUIPMENT TERMINAL CONNECTOR UNIT. --

Signed and Sealed this

Seventeenth Day of September, 2002

*Attest:*

*Attesting Officer*

JAMES E. ROGAN
*Director of the United States Patent and Trademark Office*